US005611271A

United States Patent [19]

Bielfeldt

[11] Patent Number: 5,611,271

[45] Date of Patent: Mar. 18, 1997

[54] PRESS WITH A WINDOW-TYPE TENSION FRAME

[75] Inventor: Friedrich B. Bielfeldt, Pähl, Germany

[73] Assignee: Maschinenfabrik J. Dieffenbacher GmbH & Co., Eppingen, Germany

[21] Appl. No.: 375,827

[22] Filed: Jan. 20, 1995

[30] Foreign Application Priority Data

Mar. 10, 1994 [DE] Germany ..... 44 08 101.4

[51] Int. Cl.[6] ..... B30B 7/02

[52] U.S. Cl. ..... 100/199; 425/338

[58] Field of Search ..... 100/93 P, 214, 100/194, 195, 199, 200; 425/338

[56] References Cited

U.S. PATENT DOCUMENTS 3,009,495 11/1961 Coate ..... 100/199
3,109,363 11/1963 Collins ..... 100/195
5,253,571 10/1993 Bielfeldt et al. ..... 100/41
5,323,696 6/1994 Bielfeldt et al. ..... 100/154
5,333,541 8/1994 Bielfeldt et al. ..... 100/41

FOREIGN PATENT DOCUMENTS 1528235 7/1970 Germany .

*Primary Examiner*—Stephen F. Gerrity
*Attorney, Agent, or Firm*—Foley & Lardner

[57] ABSTRACT

A press with a window type tension frame. The frame has an upper and lower crosshead with two lateral tension shackles connected together to form the window type tension frame. The crossheads and the tension shackles are removably joined together by a clamping system that employs tension bolts.

9 Claims, 5 Drawing Sheets

PRESS WITH A WINDOW-TYPE TENSION FRAME

BACKGROUND OF THE INVENTION

The invention relates to a "window" type tension frame for single-tier or multiple-tier presses (also called multiple-stage presses), and more particularly to such presses used for manufacturing chipboard, fiberboard, or other such wood-product boards and plastic boards.

DESCRIPTION OF RELATED ART

Single-tier and multiple-tier presses of the general "window frame" type are known in many different designs. This kind of design is used preferentially in multiple-tier presses. The reason is that the I-beams or box cross sections used in the vertical tension area of the window frame provide a geometrical optimum moment of resistance to the lateral shear that is mainly caused by the orientation of the material being pressed. Furthermore, it is the most cost-effective design due to the possibility of flamecutting of plates and welded plate construction. However, a press with a large number of tiers (more than 20 tiers, for example) requires a window frame with a great length due to the height of the press. This large frame can not be worked mechanically and is not transportable. The same applies in the case of very wide single-tier presses with material mats of approximately 6500 millimeters. This size press calls for a press frame with outside widths being so large that the weight per frame is about 120 metric tons. Components with such large dimensions can no longer be handled in transportation, especially over long distances. In the case of very large and heavy multiple-tier presses, the press frame construction is divided up into transportable parts, for the above-mentioned reasons.

In known single-tier and multiple-tier presses of the column design according to DE-AS 15 28 345, it is common practice to prestress the tension columns in order to prevent any loosening of the column nuts by the constantly occurring repetitive stress from zero to $P_{max}$ in cyclically operated presses. The prestress force in the tension column must be greater than the $P_{max}$ working load in order to prevent any lifting apart at the contact surfaces (nut and column offset) due to elongation by the load, both in the upper chord and in the lower chord of the press frame. Otherwise, especially where there are acidic vapors (for example in the production of chip boards or OSB boards), galling occurs very rapidly at the surfaces clamped together. This causes uncontrollable changes in the accuracy of the pressing and heating plate spacing, resulting in unacceptable variations in the finished boards. In the case of very large and heavy presses, the tension columns have to withstand the pressing force "as a load," which means the prestressing of the tension column requires a corresponding technical effort and expense.

However, if the cross section of the tension columns for withstanding the press forces is equal, the moment of resistance to lateral shear—principally in the feed direction of the press—is lower, and consequently the moment of resistance to shear or flexure is greater by about 5:1 in a welded frame cross-sectional design, and thus generally more stable and resistant to shear. Also assembly is by far more difficult, because the column ends (upper and lower) have to be pre-stressed (shrunk in) over the length held in the crosshead, so that the clamped surfaces, in the case of protracted repetitive stress produced in each working cycle from zero to $P_{max}$, must always be in intimate contact. Nevertheless, it happens in practice that, due to settling phenomena in the thread, the prestress of the column shafts is minimized, so that the junctions loosen at the clamped surfaces, and this again leads to galling.

The consequences are poorer dimensional accuracies in the finished boards and the press has to be disassembled and serviced. This is especially critical at the transition from the column to the location where the column shaft is clamped-in to the crosshead. At this indentation the column is kinked by the flexural deformation of the crosshead, which often, after years, leads to failure due to the constant stress, especially combined with galling. Consequently, to guard against damage in most applications, such heavy column presses are aftershrunk. The manufacturing costs and consequently the invested costs are higher in comparison with frame cross section design.

In the case of single-stage presses according to DE-OS 40 17 791 for application mainly as continuously operating presses, tension shackles interlockingly connecting the upper and lower crosshead are used for the sake of better lateral accessibility. The shear forces cannot be withstood by these designs. For this reason, separate supporting designs are provided in these presses. The force-transmitting surfaces between the crosshead and the tension shackles are constantly in engagement with one another in the case of continuous operation, so that prestressing is not necessary, as it is in the case of columnar designs for synchronous presses. This concept is unsuitable technologically and functionally for use in multiple-tier presses, since the longitudinal and transverse shear forces as well as the guidance functions for vertical or horizontal movements cannot be assumed.

OBJECTIVES OF THE INVENTION

One of the objectives of the invention is to create a press of the tension frame type for an especially large and heavy machine, which will have a modular press frame system which can be assembled from a plurality of parts.

Another objective of the invention is to have a press having individual modules that will be easy to transport and handle.

Another objective of the invention is to have a modular press that when fully assembled will securely accept the vertical press forces even under extreme threshold load conditions at the mechanical junctions, and which will be equipped with maximum usable moments of resistance of the tension transmitting working parts to the technologically caused, randomly oriented shear.

An advantage of the invention is to provide a press that is made up of comparatively light individual elements which is also easier to handle and transport, because in comparison to the other window-frame cross-sectional design, the individual elements have only 25% of the weight thereof.

These objectives are achieved according to the invention in that the tension frame design is made of welded steel plates and created by means of anchor bolts under tension. This arrangement prevents, with great reliability, any pulling away or loosening at the joined surfaces, so that the above-mentioned disadvantages do not occur, because the collective load on the bias system is approximately a power of ten less than it is in the column press design.

Additional advantageous embodiments of the press according to the invention will become apparent from the detailed description given below. It should be understood, however, that the detailed description, while indicating a preferred embodiment of the invention, is given by way of illustration only since various changes and modifications within the spirit and scope of the invention will become apparent to those skilled in the art.

SUMMARY OF THE INVENTION

The achieve the foregoing objectives, and in accordance with the purpose of the invention, as embodied and broadly described herein, a single-tier or multiple-tier press for the manufacture of chipboard, fiberboard or other wood-product boards and plastic boards has a lower crosshead and upper crosshead. Each crosshead is provided with four force-receiving corner areas, which are joined to two lateral tension shackles. A press cross member, with pressing and heating plates, is disposed on the lower crosshead. Also, the upper crosshead is provided with a press cross member with pressing and heating plates. Hydraulic jack pressure devices are provided in the lower crosshead for raising and lowering the pressing and heating plates mounted on the lower press cross member.

The two lateral tension shackles are provided with first and second clamping surfaces for interlockingly joining with each of the four force-receiving corner areas of the two crossheads, by first and second tension bolts, to form a united clamping frame.

BRIEF DESCRIPTION OF THE DRAWINGS

The accompanying drawings, which are incorporated in and constitute a part of the specification, illustrate a preferred embodiment of the invention, and, together with general description given above and the detailed description of the preferred embodiment given below, serve to explain the principles of the invention.

DETAILED DESCRIPTION OF THE PREFERRED EMBODIMENT

Figure 1:
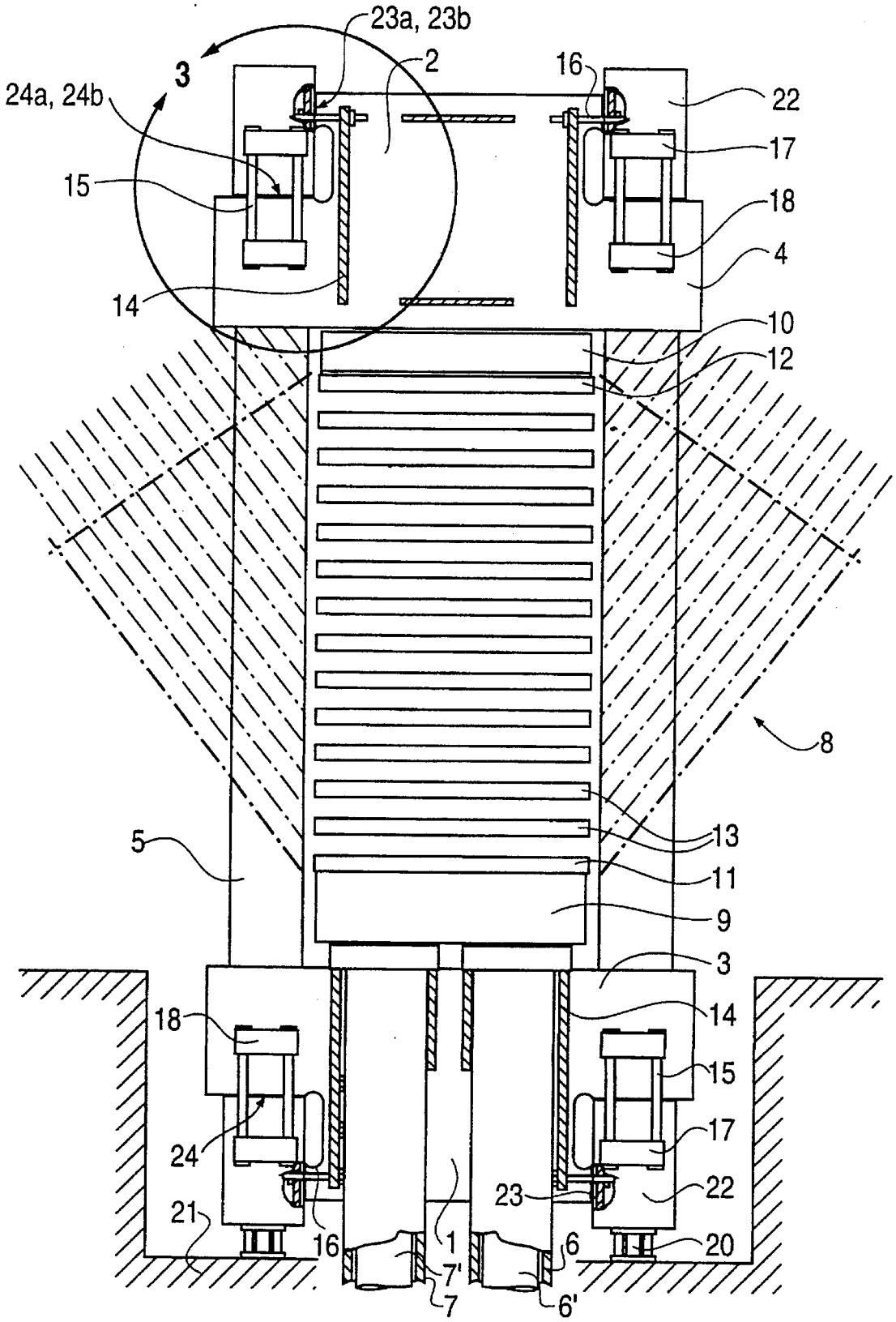
FIG. 1 is a front elevation of the press according to the invention.

A press according to the invention is shown in FIG. 1, viewed in a loading direction. As shown, the press is a multiple-tier press, although the same arrangement can be used for a single-tier press.

The press is provided with an upper crosshead 2 and a lower crosshead 1 connected under tension by tension shackles 5. Upper press cross member 10 and bottom press cross member 9 are disposed between the upper and lower crossheads 1 and 2. The bottom press cross member 9 can be raised and lowered by hydraulic jack systems 6 and 7 with pistons 6' and 7'.

The bottom press cross member 9 is equipped on its upper side with a pressing and heating plate 11. The upper press cross member 10 is equipped on its bottom side with a pressing and heating plate 12. Additional heating plates 13 of a simultaneous closing system 8 are arranged in tiers for raising and lowering between the two pressing and heating plates 11 and 12.

Figure 2:
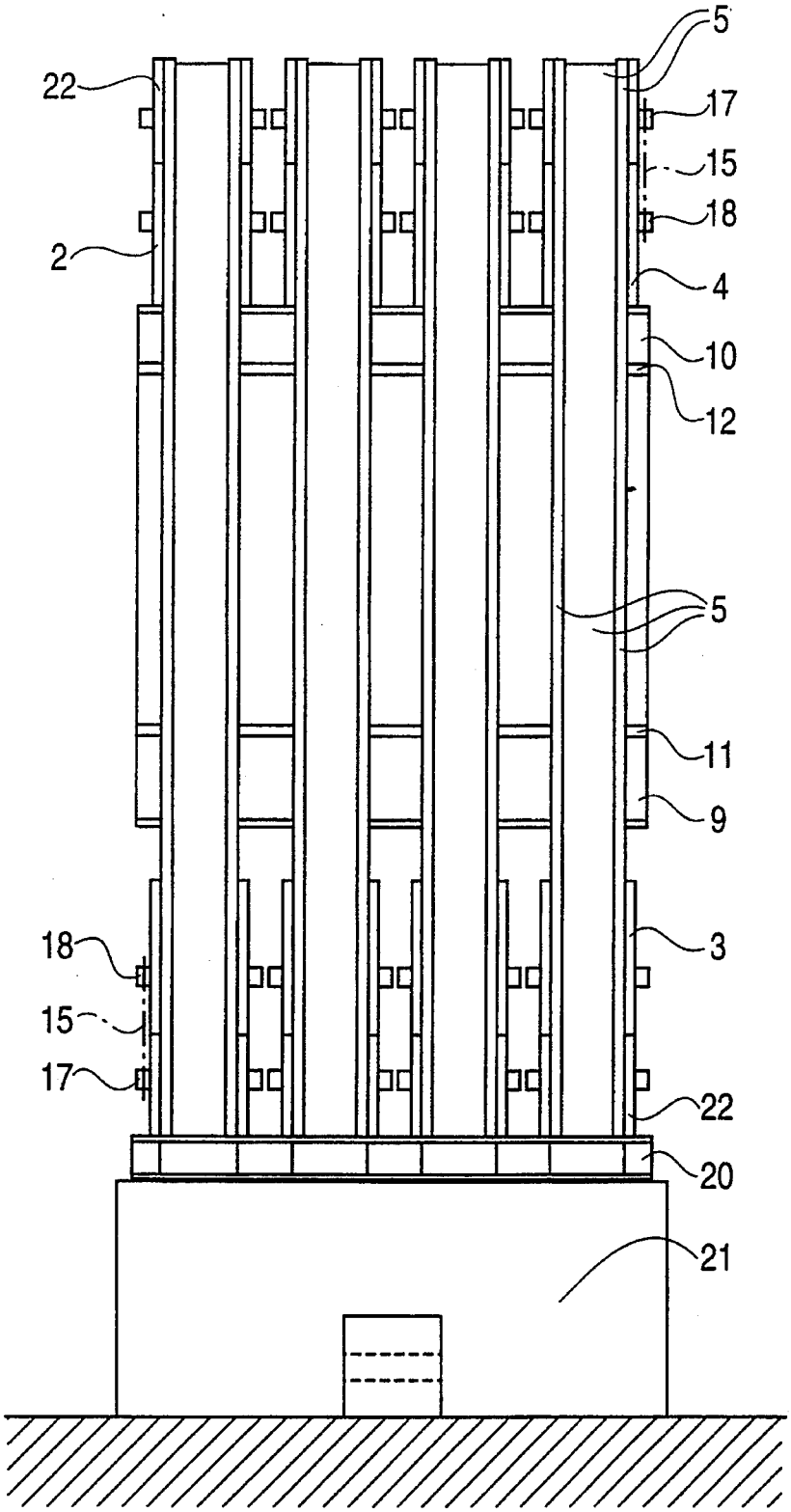
FIG. 2 is a side elevation of a longitudinal section of the press of FIG. 1.
Figure 5:
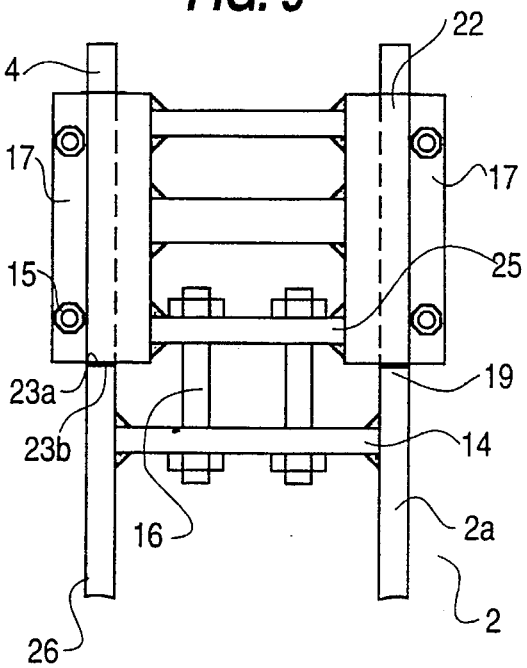
FIG. 5 is a view taken along the line 5—5 in FIG. 3.

The lower crosshead 1 has a projection 3 and the upper crosshead 2 has a projection 4. These projections establish the width of the press. As shown in FIG. 2, the thickness of the crossheads 1 and 2, disposed in tandem, establish the length of the press. The length of each crosshead 1 and 2 is established by reinforcing ribs 14 connecting the two plates that comprise the crosshead. As shown in FIG. 5, the rib 14 in crosshead 2 is welded to the plates 2*a* and 2*b*.

Figure 3:
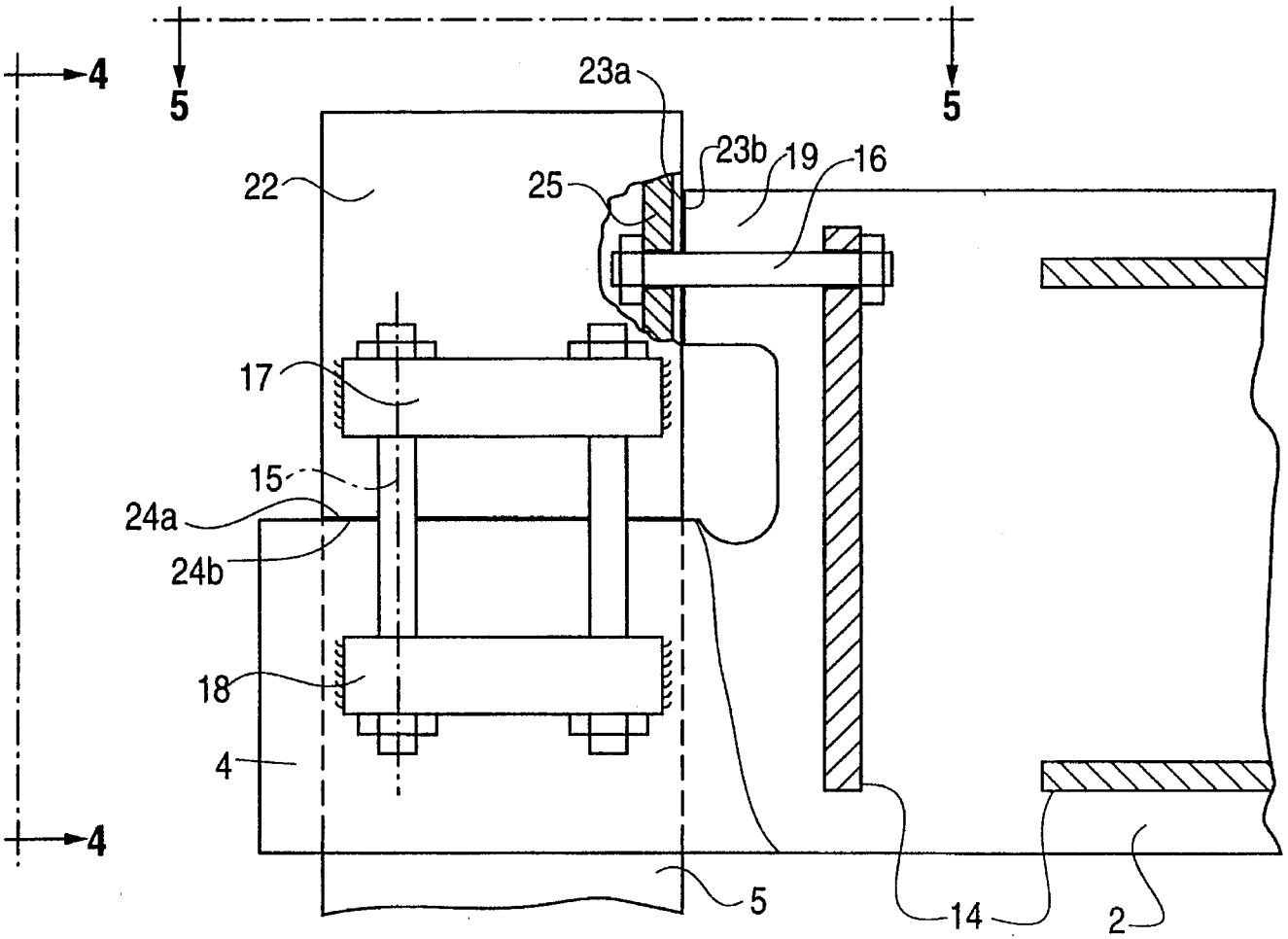
FIG. 3 is a detail of the left part of the press shown by the section 3 in FIG. 1.
Figure 4:
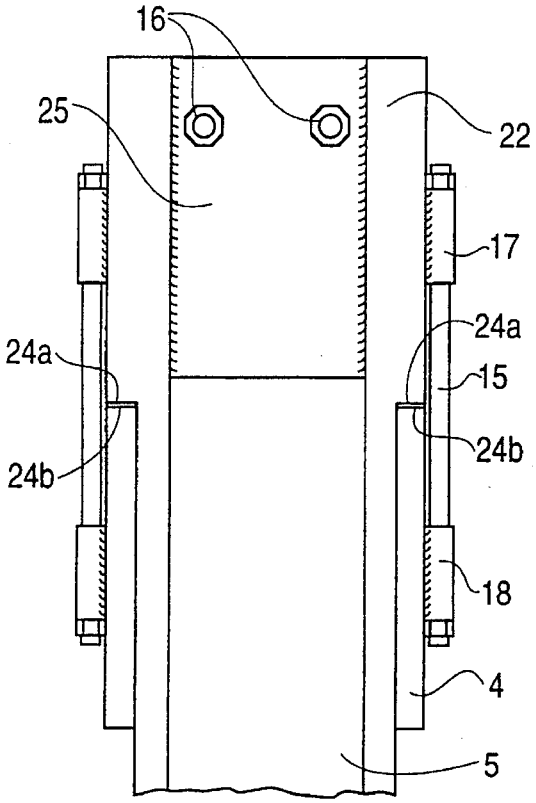
FIG. 4 is a side elevation taken along the line 4—4 in FIG. 3.

FIGS. 3–5 show the details of one corner of the frame; shown is the connection between tension shackle 5 and crosshead 2. This illustrates an example of the joint that is used in each connection between the two tension shackles 5 and the crossheads 1 and 2, as shown in FIGS. 1 and 2.

Tension shackles 5, configured in this example as I-beams, are connected between the crossheads 1 and 2. Alternatively, the tension shackles 5 can also be made with a box cross section.

As shown in FIGS. 4 and 5, the end of each tension shackle 5 is provided with welded-on cross plates 25, overlaid plates 22, and clamp cross pieces 17. The cross plates 25, overlaid plates 22, and the clamp cross pieces 17 provide an arrangement for locking the ends of the tension shackle to the crossheads 1 and 2.

Over the tension shackles 5 thus configured, the two overlaid plates 22 are placed so that their clamping surfaces 24*a* contact the horizontal clamping surfaces 24*b* of the outwardly reaching projections 4.

Tension bolts 15 are used to vertically hold together the crosshead 2 and tension shackle 5 by the clamping together of the cross piece 17 welded to the overlaid plates 22 and the cross piece 18 welded on the projection 4.

For providing horizontal tension and engagement of the tension shackle's vertical clamping surfaces 23*a* with the vertical clamping surface 23*b* of the projection or nosing 19, overlaid plates 22 are held in engagement with crosshead 2 by means of tension bolts 16 connected between one of the crosslinks 25 and one of the stiffening ribs 14.

With this arrangement provided at each connection, it allows the two crossheads 1 and 2 to withstand the pressing force applied when the press is operated.

With each side of the tension shackles 5 clamped to the crossheads 1 and 2 by the arrangement described herein and illustrated in FIGS. 1–5, the tension anchor bolts 15 and 16 hold the clamping surfaces 23*a*, 23*b*, 24*a*, 24*b* together. Welds are applied to the clamping surfaces to provide additional support to allow the frame to withstand the press forces. The press itself stands on a base 20 which is supported by a foundation 21.

The "window" frame design according to the invention provides the press with a tight clamping design. For this purpose the bias force of the vertical tension bolts 15 needs only to be designed for the inherent weight of the upper crosshead 2, the upper cross member 10, the upper pressing and heating plates 12, the simultaneous closing system 8, the hydraulic pistons 6' and 7', the material being pressed, and the dynamic mass forces.

It is important that the bias force be made such that even in the case of maximum flexure of the upper and lower crossheads 1 and 2, the mechanical positions of the tension shackles 5, provided for guiding purposes with respect to one another at the vertical clamping surfaces 23*a* and 23*b*, will remain free of free play.

Figure 6:
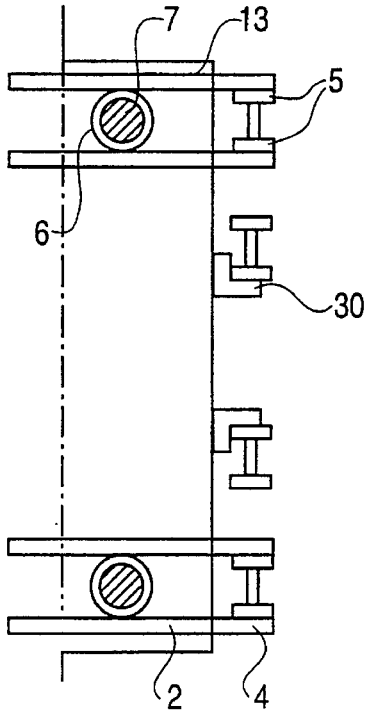
FIG. 6 is an alternative embodiment of the press shown in cross section.

In an alternative embodiment shown in FIG. 6, if two of the tension shackles 5 are made up with a rectangular box girder shape 30, their vertical guiding tracks 90° apart can serve as guiding tracks for the lower press crossbeam 9 with pressing and heating plate 11 and additional plates 13 for the vertical fast movement, while the opening and closing movement of the press is centered and the lateral thrust due to the nonrandomly spread material will be compensated lengthwise and crosswise during compression under maximum press force.

Figure 7:
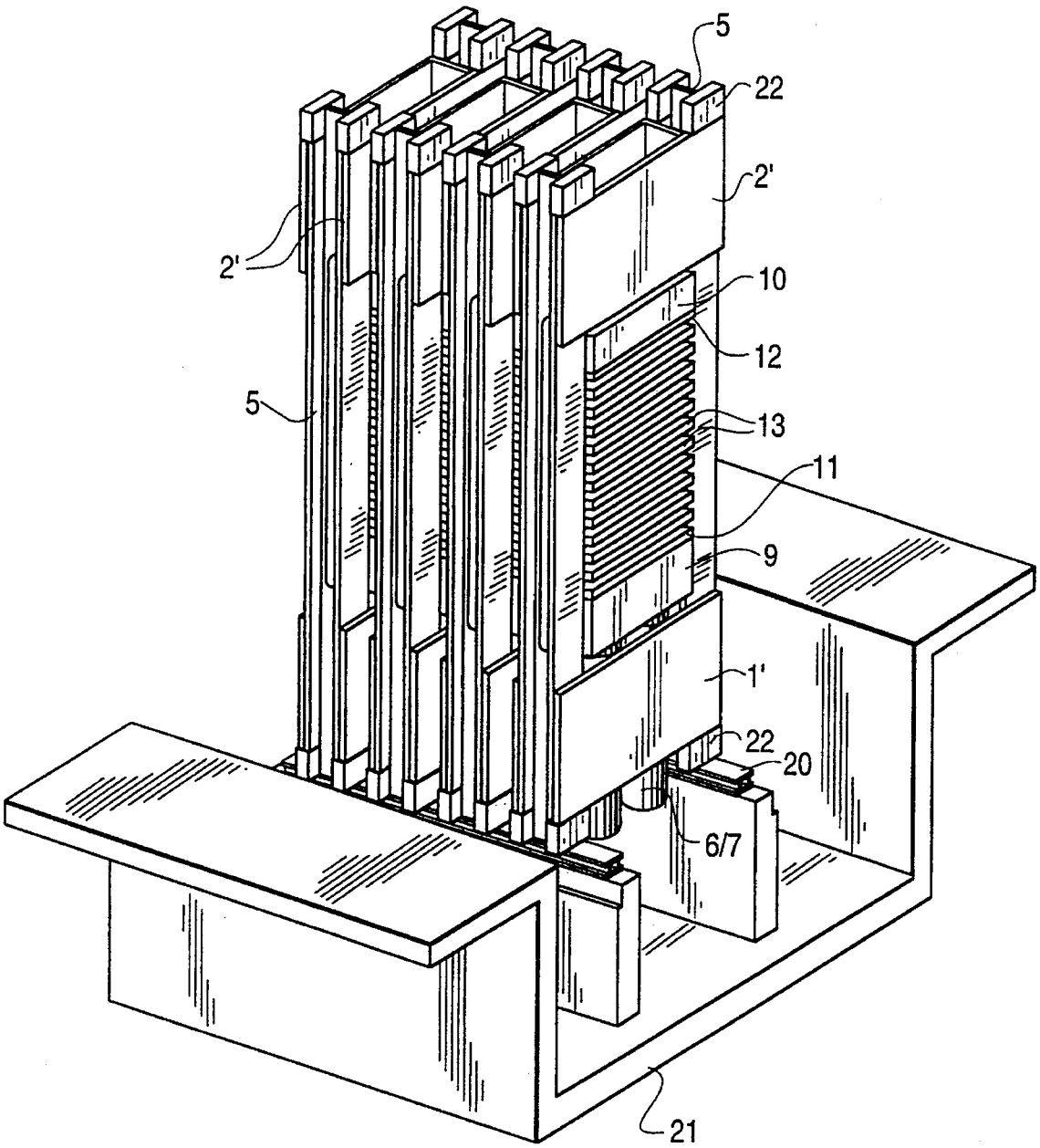
FIG. 7 shows an alternative embodiment of the press in a perspective view.

FIG. 7 shows an alternative embodiment of the invention (an embodiment without a simultaneous closing system), wherein the same reference characters have been used to identify parts similar to the first embodiment of the invention. In this embodiment, crossheads 1' and 2' are provided with a quadrilateral shape. This embodiment also uses tension bolts 15 and 16 to clamp the crossheads 1' and 2' to the tension shackles 5, however, the tension bolts and their associated crosspieces 17, 18, and 25 have been omitted from the figure for clarity.

It will be understood that various modifications in the form of the invention as described herein in its preferred embodiment may be made without departing from the spirit thereof and of the scope of the claims which follow.

What is claimed is:

1. A press with at least one tier for the manufacture of wood-product boards and plastic boards, said press comprising:

a lower crosshead and an upper crosshead, each crosshead provided with four force-receiving corner areas which are joined to two lateral tension shackles;

a lower and upper press cross member disposed on each of the lower crosshead and the upper crosshead, respectively;

pressing plates mounted on the lower and upper press cross members;

hydraulic jack pressure devices provided in the lower crosshead for raising and lowering the pressing plates mounted on the lower press cross member;

wherein first and second clamping surfaces provided on each end of the two lateral tension shackles are interlockingly joined to each of the four force-receiving corner areas of the two crossheads by first tension bolts and second tension bolts to form a united clamping frame.

2. A press according to claim 1, further comprising a simultaneous closing system provided in the press above the lower crosshead; and material to be pressed;

wherein, at least during raising of the pressing plates, the press is subject to dynamic mass forces; and wherein a bias force of the first tension bolts is selected according to the combined inherent weight of the upper crosshead, the upper press cross member, the pressing plates, the simultaneous closing system, the hydraulic jack pressure devices, the material to be pressed, and the dynamic mass forces.

3. A press according to claim 1, wherein a bias force of the second tension bolts is selected so that during flexural deformation of the lower and upper crossheads, the mechanical position of the tension shackles with respect to one another at the first clamping surfaces, that are provided for guidance purposes, will be maintained free of free play.

4. A press according to claim 1, wherein the two lateral tension shackles have a rectangular-shaped outside cross-sectional geometry to form two guiding tracks at 90° to one another, on which the lower press cross member and the pressing plates are guided centrally in a fast stroke of the press closing and opening movement, and a lateral shear of an oriented and spread material being pressed is absorbed lengthwise and crosswise by the tension shackles during compression of the material.

5. A press according to claim 1, wherein the lower crosshead and upper crosshead are provided on each of the four force-receiving corner areas with first and second clamping surfaces that correspond to the clamping surfaces of the two lateral tension shackles;

wherein the first clamping surfaces on the crossheads include clamping surfaces horizontally arranged in the press for absorbing the pressing force; and wherein the second clamping surfaces on the crossheads include clamping surfaces vertically arranged in the press for positive lateral joining of the two lateral tension shackles to the upper and lower crossheads.

6. A press according to claim 5, wherein the two lateral tension shackles are installed and removed from the lower and upper crossheads by the first and second clamping surfaces on the end of each of the two lateral tension shackles and the first and second clamping surfaces provided on the lower and upper crossheads.

7. A press according to claim 1, wherein the upper and lower crossheads include first and second clamping surfaces correlated with the clamping surfaces of the two lateral tension shackles; and wherein the corresponding clamping surfaces are welded together to form junctions that absorb pressing and biasing forces of the tension bolts such that an accurately fitting shrinkage anchoring bond is formed at right angles between the tension shackles and the crossheads.

8. A press according to claim 1, wherein the two lateral tension shackles have one of an I-beam and box-beam cross section for creating an elevated moment of resistance for the optimal absorption of shear forces and flexural forces lengthwise and crosswise in the press.

9. A press according to claim 1, wherein the lower crosshead and upper crosshead both have a quadrilateral shape.

* * * * *